United States Patent [19]

Kremar

[11] Patent Number: 4,744,720

[45] Date of Patent: May 17, 1988

[54] REEL BAR LOADING DEVICE

[75] Inventor: Djuro Kremar, Dorval, Canada

[73] Assignee: Valmet-Dominion Inc., Lachine, Canada

[21] Appl. No.: 874,160

[22] Filed: Jun. 13, 1986

[51] Int. Cl.[4] ..... B65H 17/06; B65H 19/06

[52] U.S. Cl. ..... 414/748; 198/468.6; 242/79; 414/911

[58] Field of Search ..... 198/463.4, 463.6, 468.6; 414/748, 911; 242/79

[56] References Cited

U.S. PATENT DOCUMENTS

| | | | |
|---|---|---|---|
| 1,949,997 | 3/1934 | Fourness | 242/65 |
| 2,508,566 | 5/1950 | Dunton | 242/58.6 |
| 2,835,372 | 5/1958 | Biddison | 198/463.6 X |
| 2,989,262 | 6/1961 | Hornbostel | 242/56 R |
| 3,062,389 | 11/1962 | Hunter | 414/748 |
| 3,586,253 | 6/1971 | Gilbank | 242/65 |
| 3,877,654 | 4/1975 | Randpalu et al. | 242/65 |
| 4,417,491 | 11/1983 | Vehara et al. | 414/748 X |

FOREIGN PATENT DOCUMENTS

| | | | |
|---|---|---|---|
| 875820 | 7/1971 | Canada . | |
| 960628 | 1/1975 | Canada . | |
| 1009637 | 5/1977 | Canada . | |
| 132933 | 10/1960 | U.S.S.R. | 414/748 |

*Primary Examiner*—Frank E. Werner
*Assistant Examiner*—Janice Krizek
*Attorney, Agent, or Firm*—Raymond A. Eckersley

[57] ABSTRACT

A reel bar loading device is provided with a pair of lowering arms onto which reel bars are rolled one at a time, the lowering arms being pivotally movable from an upper position adapted to receive a reel bar on a supporting surface thereof and a lower transfer position while a reel bar rolls along the length of the surface into contact with an abutment and is moved downwardly with the lowering arms into position on a reel transfer device in the lower transfer position. The reel lowering arms are preferably provided with a cam stop that moves into stopping position to stop movement of reel bars into a loading position when the lowering arms are not in their upper positions.

6 Claims, 1 Drawing Sheet

REEL BAR LOADING DEVICE

FIELD OF THE INVENTION

The present invention relates to a reel loading device adapted to feed reels from an upper supporting rack onto transfer arms which move the reel into winding position in a paper making machine.

BACKGROUND OF THE INVENTION

A variety of different reel lowering devices for transferring a reel from a supporting rack for storing empty reel bars into a transfer means to move the reel bars into a winding position have been proposed and many such devices are currently in use. For example U.S. Pat. No. 1,949,997 issued Mar. 6, 1934 to Fourness describes a paper winder wherein empty cores are carried from a lower rack via a pair of arms and moved into winding position against a winding drum to form a roll of paper. The shaft of the paper core is transferred from grooves or slots in the arms transferring the core to the winding position into co-operating slots formed in a second pair of transfer arms that carry a finished or wound roll of paper into a second storage rack located above the storage rack for empty reels. This device provides for the loading and unloading of reels and wound paper rolls respectively from a winding position but is a relatively expensive and cumbersome piece of equipment.

U.S. Pat. No. 2,508,566 issued May 23, 1950 to Dunton describes a web roll backstand and provides for a transfer of a wound roll into an unwind station and removal of the cores. A pair of arms is used to make the transfer into the unreeling position and a second pair of arms is used to transfer the empty reel or core to a second storage position. Although this device is not a device for transferring empty reels into a transfer arm it does show the use of spaced arms to make the transfer of the roll into an operating position.

U.S. Pat. No. 2,989,262 issued June 20, 1961 to Hornbostel teaches the use of gravity to roll a plurality of empty cores and apply same one at a time from an inclined storage device into a loading position where they are picked up by a transfer arm and moved into winding position between a pair of winding drums. The mechanism for controlling the flow of empty cores down the relatively steep incline of the storage device leads to significant complications in this structure of the winder.

Yet another example of a reel loader is shown in U.S. Pat. No. 3,586,253 issued June 22, 1971 to Gilbank et al. In this device empty reels are loaded onto an upper rack formed by a pair of rails having an abutment stop at their lower ends so the empty reels move down the rails to the abutment stop. A pair of lifting and lowering arms are provided which lifts each empty reel over the abutment and permits it to roll to the opposite side thereof and then lowers the reel into the reel transfer device. Obviously the operations of the reel lowering arms in the arrangement require both the lifting over the abutment, transverse movement to direct the reel to the opposite side of the abutment and then lowering of the reel into the transfer device. The opposite side of the abutment in this case operates as a cam to hold the reel in position during the initial phases of lowering of the lowering arms so that there is a controlled movement of the reel along the lowering arms. Obviously the reciprocal motion of the arm during loading complicates the operation of the lowering arms in that they first must move upward to lift the reel bars above the abutment and then downward after the reel bars have moved along the arm to the opposite side of the abutment into a transfer position.

U.S. Pat. No. 3,877,654 issued April 15, 1975 to Randpalu et al utilizes transfer arms as a transfer device in the normal manner to move a reel bar into winding position and also as a lowering mechanism. The transfer arms are extended so that the clamp may move along the arms to an upper position to receive reels located on the storage rack thereabove. Obviously such extension of the transfer arms requires a controlled movement of the reels along the storage rack to permit the transfer arms to rotate and requires a more elaborate clamping mechanism which is transported along the transfer arms.

In a number of the above arrangements, the lowering mechanism must always be used to transfer a reel bar to the transfer mechanism and it is not possible to load a reel onto the transfer mechanism directly from a crane. As a result, if the lowering device breaks down a new reel cannot be loaded onto the transfer mechanism.

BRIEF DESCRIPTION OF THE INVENTION

It is an object of the present invention to provide a simplified mechanism for lowering the empty reels from the storage rack onto transfer arms by a simple pivotal movement from an upper position to a lower position.

It is a further object of the present invention to provide a structure wherein if the lowering device is inoperative for any reason, the crane can be used to directly load the reel bar onto the transfer device.

Broadly the present invention relates to a reel bar loading mechanism comprising, a rack sloping downward from one end towards another end thereof so that a reel bar may be supported for rolling movement therealong in a direction towards another end, lowering means comprising a pair of interconnected horizontally spaced arms pivotally mounted below said rack on a horizontal pivot means positioned between said one and said other end and adjacent said other end, means to pivot said arms in unison between an upper receiving position and a lower transfer position, each said arm having an upwardly facing support surface extending therealong and each terminating in an abutment means adjacent one end of its respective said arm, one of said arms being located adjacent one axial end of said reel bar and the other said arms located adjacent the opposite end of said reel bar supported on said rack, each of said surfaces being positioned to engage said reel bar on said rack adjacent the opposite axial ends of said reel bar, at least one portion of each said surface sloping upward to obstruct further movement of said reel bar in said direction, said means to pivot pivots said arms in unison about said pivot means to move said surfaces into a downward sloping position wherein a reel bar supported on said lowering arms moves along said surfaces and into contact with said abutment means and further pivots said arms to move a reel bar supported on said arms and engaging said abutment means into a transfer position.

A cam stop is preferably provided at the end of each of said arms remote from its respective said abutment means, said cam stop moving into position to prevent movement of reel bars along said rack while said arms are downwardly from said upper receiving position.

Preferably the surface on each of said arms will be composed of said one portion, a lead-in portion and an extend portion, said lead-in portion when the arms are in the upper position preferably will be substantially horizontal or will slope downward at a lesser angle than the slope of said rack, said lead in and said one portion intersecting to form a cradle in which a reel bar is supported immediately before said arms are from said upper position and said extend portion extends from said one portion to said abutment in an upward direction when said arms are in their upper position.

If desired, said extend portion may be a simple extension of said one portion e.g. the one and extend portion are the same surface.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
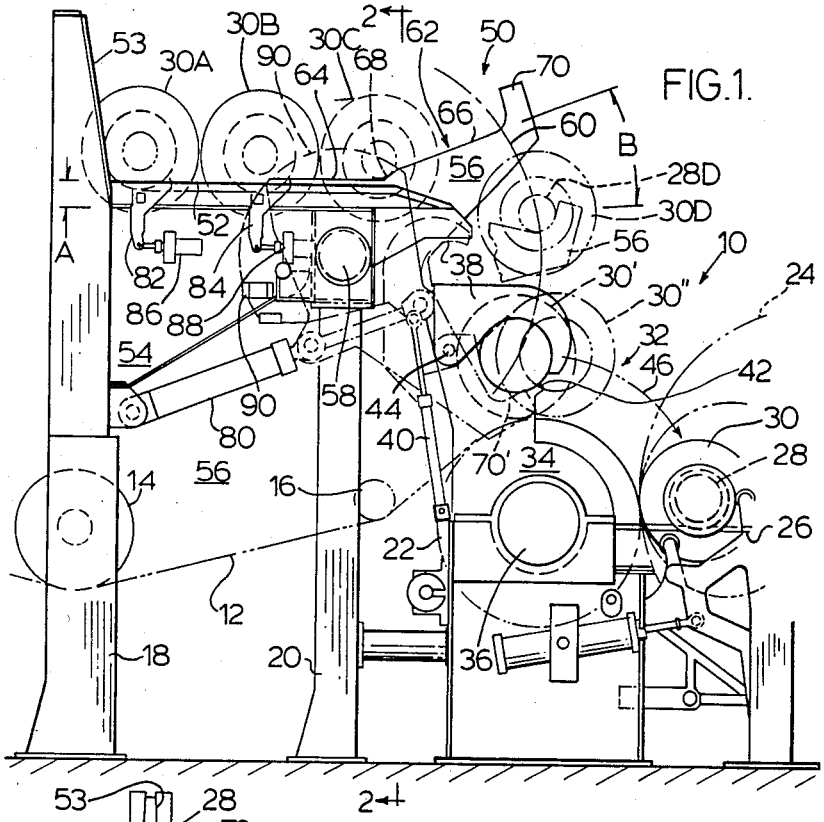
FIG. 1 is a schematic side elevation illustrating the present invention and the operation thereof.

A winding station 10 is illustrated in FIG. 1 wherein a paper web 12 passes over guide rolls 14 and 16 mounted on support columns 18 and 20 respectively and onto a drive roll 22 to be wound into a paper roll 24 that is supported on rails 26 (only one shown) via the hubs 28 of the reel bar 30 onto which the paper web is wound.

A new reel bar is moved into winding position on the rails 26 to have the paper web wound therearound by means of the reel transfer mechanism generally indicated at 32. This reel transfer mechanism 32 is composed of a pair of arms 34 located one at each side of the machine (only one shown) and mounted to rotate on the pivotal axle 36 of the drive roll 22. Each arm 34 is provided with a jaw 42 adjacent its free end and a cooperating pivoted jaw 38 that is actuated by piston and cylinder arrangement 40 to clamp a hub 28 of reel bar 30, reel bar 30 indicated in dash lines in FIG. 1, between the jaw 38 and the jaw 42. The arm 34 is rotated around the axle 36 as indicated by the arrow 46 to move a reel bar such as the reel bar 30' shown in dash lines in FIG. 1 into the winding position. The jaw 38 is shown in dash lines in the open position and as a solid line in the closed position.

An important feature of the present invention is the lowering mechanism generally indicated at 50 which takes a reel bar such as those indicated at 30A, 30B and 30C one at a time and transfers it to the transfer mechanism 32 from a rack formed by a pair of tracks 52 (only one shown) supported on the frame 54 which in turn is supported on the pillars 18 and 20. The upper surfaces of the tracks 52 slope downward and to the right in FIG. 1 i.e. toward the winding station 10 at an angle A which normally will be about ½ to 2° so that the reel bars will tend to move (roll) toward the right in FIG. 1. In the arrangement illustrated the upper surface of the tracks 52 is a straight line i.e. constant slope but the slope need not be constant and the upper surface may be curved, it simply being important that the reels supported thereon move toward the winding station 10 as required. A suitable abutment 53 is provided as an upward extension of the upper ends of the rails 52.

The lowering device 50 is composed of a pair of horizontally spaced arms 56 (only one shown) pivotally mounted on the frame 54 via the axle 58 for movement as indicated by the arc 60 from an upper reel bar receiving position shown in solid lines in FIG. 1 to a lower transfer position as shown in dash lines.

It will be noted that each of the arms 56 in the illustrated arrangement is provided with an upper supporting surface 62 which is formed by a lead-in portion 64 and an upwardly sloped extend portion 66 that are interconnected by an obstructing portion 68 which stops movement of a reel bar and forms a cradle to position the next reel (reel 30C) to be transferred, in a position ready for lowering into the lower transfer position of the transfer arm 34. The obstructing portion 68 will be at a greater angle to the horizontal than the sloped portion 68 to provide a positive stop, but will not be so steep as to require the angular position of the arms 56 to be so low when the reel rolls from surface 68 to surface 66 that the reels do not roll relatively smoothly off of the portion 68 and onto the portion 66 as the arms 56 are rotated, i.e. there will not be too great a change in speed of the reel when it passes onto surface 66 or in other words the angular relationship of the abutment portion 68 and extend portion 66 will not be that significant.

In the upper position shown in FIG. 1 the sloped support surface portion 66 extends at an angle B to the horizontal so that it slopes upwardly from the horizontal (at a lesser slope than the portion 68 by a few degrees) toward the abutment 70 positioned adjacent the end of the arm 56. The curved abutment 70 forms a further cradle for supporting a reel after it rolls down the surface 66 and is further lowered onto the transfer device 32 as will be described in more detail herebelow.

In the arrangement illustrated in FIG. 1 lead-in support surface portion 64 of each arm 56 is substantially horizontal and projects above the top of the rail 52 so that the reels such as the reel 30C is transferred from the top of the rail 52 onto the arms 56 to be supported thereby. These lead-in portions 64 need not be horizontal but should have less slope than the rails 52 and should be oriented to the rails 52 so the reel bars roll smoothly off the rails 52 onto and along surface 64 of the arms 56 as the reel bars move to the right in FIG. 1 toward the obstructing portion 68.

Figure 3:
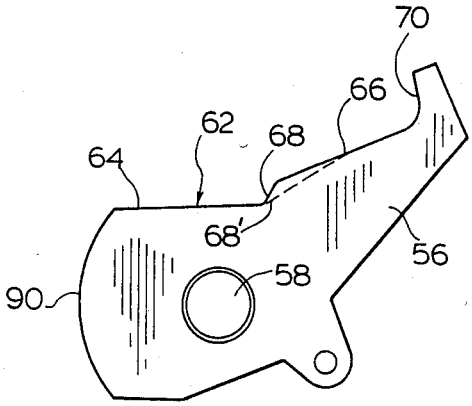
FIG. 3 is an isolated view of a lowering arm of the invention.

The surface portion 68 may be completely omitted if desired and the surfaces 64 and 66 simply intersect at an apex 68' illustrated in FIG. 3 by the dash line portion of surface 66 intersecting the surface 64. In this case the surface 66 functions also to stop movement of the reel bar to the right (in FIG. 1) and a reel bar will be cradled in the apex 68' formed at the intersection of the surfaces 64 and 66 in substantially the same position as reel bar 30C in FIG. 1.

The slope A may for example be 2 degrees above horizontal and the slope B say 5 degrees above horizontal.

Figure 2:
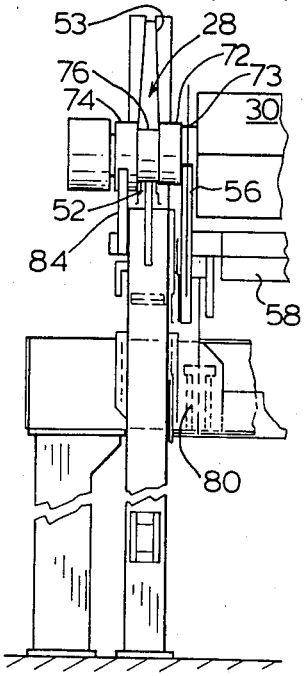
FIG. 2 is a view along the line 2—2 of FIG. 1 illustrating the location of the lowering mechanism at one side of the machine (there being a similar mechanism at the other side of the machine)

The arms 56 located one on each side of the machine are interconnected for example by the axle 58 (see FIG. 2) and are each positioned inside of the frame members 20 on their respective side of the machine in position to engage a different portion of the hubs 28 then the rail 52. As shown in FIG. 2 the arm 56 is interposed between the first boss or inner boss 72 on the hubs 28 and the body of the reel 30 so that it engages and supports the reel 30 on the shaft portion 73 of the hubs 28.

The rails 52 support the reels 30 by engagement with the reduced diameter sections 76 positioned between the inner boss 72 and the outer boss 74 on the hubs 28 at opposite ends of the reels 30.

It will be apparent that there is a rail 52 and a supporting structure 54 positioned one at each side of the machine so that both ends of the reels 30 are supported on their respective rails 52. Similarly as above indicated there are arms 56 positioned one at each side of the machine to engage a hub portion 73 on that side of the reel and that these arms 56 move in unison between the solid line position to the dot dash line position shown in FIG. 1 due to their interconnection for example by the axle 58. The arms 56 are pivoted with axle 58 by means of the piston and cylinder arrangement generally indicated at 80.

If desired retractable stops such as those indicated at 82 and 84 may be provided along tracks 52 on opposite sides of the machine in position to stop the movement of the reels such as the reels 30A and 30B down the inclined tracks 52. These stops may be actuated by any suitable means such as piston and cylinders 86 and 88 respectively which may be manually or automatically controlled.

Referring to FIGS. 1 and 3 it will be seen that the end of the arm 56 remote from the abutment 70 is provided with a cam stop 90 that provides a safety feature preventing advancement of any reel supported on the track 52 and positioned in the illustrated arrangement to the left of the cam stop 90 i.e. the reel bar 30B in FIG. 1. When the lowering mechanism is actuated to move the arm 56 from the solid line position shown in FIG. 1 to the position shown in dot dash lines in FIG. 1 the cam stop 90 becomes operative and moves into stopping position i.e. the cam surface 90 has a radius relative to the axle 58 longer than the shortest distance between the axis of rotation of the axle 58 and the surface 64 by a length sufficient so that the camming surface 90 moves to a position above the track or rail 52 and into a position to engage the reduced diameter portions 73 of the reel 30B (see FIGS. 1 and 2) should for some reason or other the latch of stop 84 be released prematurely. Generally it is preferred to utilize the stop 84 and prevent the scrubbing motion of the cam surface 90 against the reduced diameter section 73, however, the safety feature of the curved cam stop 90 guards against any accidental advance of the reel such as reel 30B when the arms 56 are out of their upper or elevated receiving position shown in solid lines in FIG. 1.

The operation of the device is as follows.

When the roll 14 of paper is completed a new reel such as reel 30' in transfer device 32 is moved into position by rotation of the reel transfer device 32 as indicated by the arrow 46. A reel 30' is held by the clamping jaw 38 against the upper surface of a co-operating jaw 42 of the arm 34 by expanding the piston and cylinder 40 as illustrated in FIG. 1. This movement of the arms 34 in the direction of the arrow 46 clears the reel 30' over the end edge of the abutments 70 of the arms 56 so that the arms 56 may now be raised to the upper position as shown in solid lines in FIG. 1. This is accomplished by expanding the piston and cylinder 80 to move the arms 56 into their elevated position of FIG. 1.

When the arms 56 are positioned as illustrated in solid lines, the stop 84 is released and the reel that is indicated at 30B in FIG. 1 rolls down the tracks 52 from the position of the reel 30B onto the surfaces 64 of the arms 56 into the position of the reel 30C where further movement is obstructed by the obstructing portion 68 of surface 62 (or portion 66 if portion 68 is omitted) and is cradled in a stable location between the two surfaces 64 and 68 (or 66) in readiness to be fed to the transfer position 32.

Transfer arms 34 (there being one at each end of the machine) are pivotted back to the position as shown in FIG. 1 however at this point in time there is no reel carried in the arms 34 and the clamp jaws 38 are in the open position as shown by dot dash lines in FIG. 1.

When it is desired to move a reel such as the reel bar 30C in FIG. 1 to the position shown at 30' the piston and cylinder 80 is retracted thereby swinging the arms 56 downward in the direction of the arc 60 with the axle 58 to move the ends of the arms 56 having the abutments 70 downward to the position shown in dot dash lines. Such downward movement of the arms 56 moves the surfaces 68 to a negative slope angle and surfaces 66 from the positive slope angle B shown in FIG. 1 to a negative slope so that the reel bar 30C carried on the arms 56 rolls off the abutment portions 68 and down these surfaces 66 until their hubs rest against the abutments 70 as shown by the dotted line position of the hub 28D in FIG. 1.

After the reel 30C reaches the position such as that illustrated in dotted lines at 30D in FIG. 1 the pivotal movement of the arms 56 is continued in the same direction to move the reel 30D into the position 30' with the hubs 28' resting against the support surfaces 42 at the ends of the arms 34. As the arms 56 are moved downward the cam surfaces 90 rise above the level of the tracks 52 to ensure that the next reel 30B cannot advance and roll off the free ends of the tracks 52. Obviously after the reel such as the reel 30' is positioned as illustrated, clamp jaw 38 is closed i.e. moved to the solid line position to hold the reel bar 30' in position and then the arms 34 are advanced as indicated by the arrow 46 at the appropriate time to repeat the cycle and move the reel bar 30' through the position illustrated by reel bar 30'' to the position illustrated by reel bar 30 for winding a reel of paper thereon.

It will be noted that to the right of the lowering means 50 in FIG. 1 there is an open space that provides access to the transfer device 32 so that a crane may be used to carry a reel bar through this space to the right of lowering means 50 and load it directly onto the transfer device 32 in the position 30' in the event the lowering mechanism 50 for some reason cannot be used.

Having the described the invention modifications will be evident to those skilled in the art without departing from the spirit of the invention as defined in the appended claims.

What I claim as new and desire to secure by Letters Patent of the United States is:

1. A reel bar loader for loading a reel bar into a winding posiiton in a paper making machine, comprising:

rack means adapted to carry a plurality of reel bars and sloping downwardly from one end towards the other end thereof, transfer arm means for depositing one of the reel bars into said winding position, said transfer arm means being moveable between a first receiving position located directly beneath said other end of said rack means for receiving said one reel bar and a first transfer position adapted to transfer said one reel bar into said winding position, and, reel bar lowering means for lowering said one reel bar from the rack means directly onto said transfer arm means in said first receiving position, said reel bar lowering means comprising a pair of interconnected horizontally spaced lowering arms pivotally mounted below said rack means on a pivotal axis positioned between said one and said other end and adjacent said other end for pivotal movement from a second upper receiving position to a second lower transfer position, when in said second upper receiving position each of said lowering arms having an upper support surface having at least one portion thereof sloping upwardly relative to the horizontal adjacent the said other end of said rack means to engage and support a hub of said one reel bar whereby movment of said one reel bar in a direction down said rack means is arrested by said upward sloping portion of said surface, said lowering arms further including abutment means at the end of said upper support surface remote from the pivoted axis of said lowering arms, said abutment means arresting movement of said one reel bar over said supporting surface as the lowering arms are pivoted to said second lower transfer position and preventing said one reel bar from moving off said lowering arms, when in said second lower transfer position support of said one reel bar being transferred from said lowering arms directly to said transfer arm means, said reel bar lowering means being returnable to said upper receiving position to support another one of said reel bars once said arm transfer means has moved into said first transfer position to deposit said one reel bar in said winding position.

2. A reel bar loading mechanism as defined in claim 1 wherein a cam stop means extends from said support surface of each said lowering arm rearwardly in the direction of movement of said reel bars down said rack, said cam stop means being positioned and shaped so that rotational movement of said lowering arms from said second upper receiving position towards said second lower transfer position raises said cam stop means from a nonobstructing to an obstructing position preventing movement of said reel bars downwardly along said rack.

3. A reel bar loading mechanism as defined in claim 2 wherein said transfer arm means includes a clamp moveable from an open position to a closed position to hold said one reel bar on said transfer arm, and said mechanism further including means to pivot said lowering arm to move said one reel bar into position in said clamp on said transfer arms.

4. A reel bar loading mechanism as defined in claim 1 wherein said upper support surface of said lowering arm has a lead-in portion, said lead-in portion and said at least one sloping portion of said upper support surface meeting at an apex to define a cradle to support said one reel bar thereon when said reel bar lowering means is in the second upper receiving position.

5. A reel bar loading mechanism as defined in claim 2 wherein said upper support surface of said lowering arm has a lead-in portion, said lead-in portion and said at least one sloping portion of said upper support surface meeting at an apex to define a cradle to support said one reel bar thereon when said reel bar lowering means is in the second upper receiving position.

6. A reel bar loading mechanism as defined in claim 3 wherein said upper support surface of said lowering arm has a lead-in portion, said lead-in portion and said at least one sloping portion of said upper support surface meeting at an apex to define a cradle to support said one reel bar thereon when said reel bar lowering means is in the second upper receiving position.

* * * * *